US009022518B2

(12) United States Patent
Tokai

(10) Patent No.: US 9,022,518 B2
(45) Date of Patent: May 5, 2015

(54) RECORDING APPARATUS

(71) Applicant: Seiko Epson Corporation, Tokyo (JP)

(72) Inventor: Yoshitsugu Tokai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,222

(22) Filed: Mar. 24, 2014

(65) Prior Publication Data

US 2014/0292890 A1 Oct. 2, 2014

(30) Foreign Application Priority Data

Mar. 27, 2013 (JP) ..... 2013-065986

(51) Int. Cl.

| | |
|---|---|
| ***B41J 29/393*** | (2006.01) |
| ***B41J 2/01*** | (2006.01) |
| ***B41J 2/045*** | (2006.01) |
| ***B41J 2/15*** | (2006.01) |

(52) U.S. Cl.

CPC ..... *B41J 29/393* (2013.01); *B41J 2/01* (2013.01); *B41J 2/04556* (2013.01); *B41J 2/15* (2013.01)

(58) Field of Classification Search

CPC ..... B41J 29/393; B41J 2/04556
USPC ..... 347/16, 19, 37, 104, 22
See application file for complete search history.

(56) References Cited

U.S. PATENT DOCUMENTS

| | | | | |
|---|---|---|---|---|
| 8,864,278 | B2 * | 10/2014 | Donahue et al. | 347/19 |
| 2005/0151773 | A1 | 7/2005 | Watarai | |
| 2013/0265362 | A1 * | 10/2013 | Toya | 347/19 |

FOREIGN PATENT DOCUMENTS

| | | |
|---|---|---|
| JP | 2005-199507 | 7/2005 |
| JP | 2005-335247 | 12/2005 |
| JP | 2006-240082 | 9/2006 |
| JP | 2010-221644 | 10/2010 |
| JP | 2012-210781 | 11/2012 |

* cited by examiner

*Primary Examiner* — Julian Huffman
(74) *Attorney, Agent, or Firm* — Workman Nydegger

(57) ABSTRACT

There is provided a recording apparatus including a support stage which supports a recording medium, a recording processing section which includes a recording unit for performing recording on the supported recording medium and is bridged so as to cross over the support stage in an X-axis direction, a Y-axis moving section which moves the recording processing section in a Y-axis direction with respect to the support stage, and a collision detection section which detects collision between a foreign matter and the recording processing section, in which the recording processing section includes projecting sections projecting in the X-axis direction with respect to the support stage, and side collision detection sections are respectively arranged on front and rear sides of the respective projecting sections.

8 Claims, 10 Drawing Sheets

RECORDING APPARATUS

BACKGROUND

1. Technical Field

The present invention relates to a so-called flatbed type recording apparatus which performs recording by moving a recording unit with respect to a recording medium on a stage.

2. Related Art

In the related art, a recording apparatus which includes a stage section for supporting a recording medium, a recording unit facing the stage section, a Y-axis unit crossing over the stage section in a horizontal direction, and an X-axis moving mechanism for moving the Y-axis unit in an X-axis direction has been known (see JP-A-2012-210781). The Y-axis unit includes a pair of right and left projecting sections which are provided so as to extend in the horizontal direction over the stage section.

However, there is a concern that a foreign matter collides with the right and left projecting sections sticking out of the stage section when the Y-axis unit is moved by the X-axis moving mechanism in such a configuration. It is a matter of course that the foreign matter is damaged if the X-axis moving mechanism is continuously driven at this time, and there is also a problem in that the recording apparatus itself is damaged.

SUMMARY

An advantage of some aspects of the invention is to provide a recording apparatus capable of preventing a foreign matter and the recording apparatus itself from being damaged when the foreign matter collides with the right and left projecting sections.

According to an aspect of the invention, there is provided a recording apparatus including: a stage which includes a support surface for supporting a recording medium; a recording processing section which includes a recording unit for performing recording on the recording medium supported by the stage and is bridged so as to cross over the stage in a first direction; a first moving section which moves the recording processing section in a second direction perpendicular to the first direction and along the support surface, with respect to the stage; and a first collision detection section which detects collision between a foreign matter and the recording processing section, in which the recording processing section includes projecting sections which project in the first direction with respect to the stage, and in which the first collision detection section is arranged on at least one of one side and the other side of the projecting sections in the second direction.

With such a configuration, it is possible to detect that the foreign matter has collided with the projecting sections by arranging the first collision detection section which is brought into contact with the foreign matter and detects collision on one side or the other side of the projecting sections in the second direction. Therefore, it is possible to quickly stop driving the first moving section, for example, when the foreign matter collides with the projecting sections and to thereby prevent the foreign matter and the recording apparatus itself from being damaged.

In this case, it is preferable that the recording processing section include an overlapped section which is overlapped with the stage in the first direction, and that the recording apparatus further include a second collision detection section which is arranged on at least one of one side and the other side of the overlapped section in the second direction and detect collision between the recording medium or the foreign matter and the recording processing section.

With such a configuration, it is possible to detect that the recording medium supported by the stage has collided with the overlapped section by arranging the second collision detection section which is brought into contact with the recording medium or the foreign matter and detects collision of the recording medium or the foreign matter on one side or the other side of the overlapped section in the second direction. Therefore, it is possible to quickly stop driving the moving section, for example, when the height of the recording medium is high and the recording medium collides with the overlapped section and to thereby effectively prevent the recording medium or the recording processing section itself from being damaged.

In this case, it is preferable that the first collision detection section be arranged at a position projecting further than the second collision detection section in the second direction.

With such a configuration, the first collision detection section first detects collision when the foreign matter is present over the inside and the outside of the stage in the first direction, by arranging the first collision detection section arranged in the projecting section of the recording processing section at a position projecting further in the second direction than the second collision detection section arranged at the overlapped section of the recording processing section. Therefore, it is possible to effectively prevent the recording processing section from being damaged without causing collision itself of the foreign matter at the overlapped section.

In this case, it is preferable that the first collision detection section be arranged at a lower position than the stage.

However, there is a problem that collision between a foreign matter at a lower position than the stage and the projecting sections cannot be detected if the first collision detection section is arranged at a higher position than the stage.

Nonetheless, it is possible to detect the collision between the foreign matter at a lower position than the stage and the projecting sections by arranging the first collision detection section at a lower position than the stage as in the aforementioned configuration.

In this case, it is preferable that the first collision detection section include a first contact section which is able to be brought into contact with the foreign matter.

With such a configuration, it is possible to precisely detect collision of the foreign matter by providing the first contact section.

In this case, it is preferable that the recording apparatus further include a medium detection section which detects a distance between the recording unit and the recording medium in a direction in which the recording unit faces the stage, and that the medium detection section include a contact-type first detection section which performs lower limit detection of the distance between the recording unit and the recording medium and an optical-type second detection section which performs upper limit detection of the distance between the recording unit and the recording medium.

Since the detection sections are brought into a contact state even in a normal case if both the detection sections for the upper limit detection and the lower limit detection are configured of contact-type detection sections, there is a problem in that the surface of the recording medium is damaged with a high possibility. In contrast, if both the detection sections are configured of optical-type detection sections, there is a problem in that adjustment after attachment (optical axis adjustment, in particular) is complicated.

In contrast, it is possible to reduce the possibility that the recording medium is damaged and facilitate the adjustment after the attachment by providing the contact-type first detection section and the optical-type second detection section as in the aforementioned configuration.

In this case, it is preferable that the first detection section include a plurality of second contact sections which are aligned and arranged in the first direction and are able to be brought into contact with the recording medium, and that the plurality of second contact sections be supported by the recording processing section.

With such a configuration, it is possible to perform the lower limit detection at the respective positions on the recording medium in the first direction by aligning and arranging the second contact sections in the right-left direction. Accordingly, even if unevenness or bending (floating) occurs in the first direction, and the distance is partially less than the lower limit, it is possible to detect the unevenness or the bending. In addition, it is possible to perform the lower limit detection at the respective positions on the recording medium in the second direction since the second contact sections are supported by the recording processing section and can be moved along with the recording processing section. Accordingly, even if unevenness or bending (floating) occurs in the second direction, and the distance is partially less than the lower limit, it is possible to detect the unevenness or the bending.

In this case, it is preferable that the recording processing section further include a second moving section for moving movable bodies including the recording unit in the direction in which the recording unit faces the stage and a third collision detection section which detects collision between the foreign matter and the recording unit when the movable bodies are moved in the facing direction by the second moving section.

With such a configuration, it is possible to detect that the foreign matter has been pinched between the movable bodies and the stage (or the recording medium) during movement by the second moving section. Therefore, it is possible to quickly stop driving the second moving section and move the movable bodies to separate therefrom and to thereby effectively prevent the foreign matter and the recording apparatus itself from being damaged when the foreign matter is pinched.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a description will be given of a recording apparatus according to an embodiment of the invention with reference to the accompanying drawings. The recording apparatus records a desired image on a recording medium by ejecting ultraviolet curable ink based on an ink jet scheme. In addition, the recording apparatus is a so-called flatbed type recording apparatus which performs recording by moving a recording head with respect to the recording medium supported by a support stage. As the recording medium, recording media with different thicknesses, such as a paperboard, a wood material, a tile, a plastic board, and cardboard, are assumed. An X-axis (horizontal) direction, a Y-axis (front-back) direction, and a Z-axis (upper-lower) direction are defined as shown in the respective drawings, and the following description will be given. The Y-axis direction and the X-axis direction are directions along a support surface (set surface) of the support stage. A near side in FIG. 1 is referred to as a front side of the recording apparatus, and a far side in FIG. 1 is referred to as a rear side of the recording apparatus.

Figure 1:
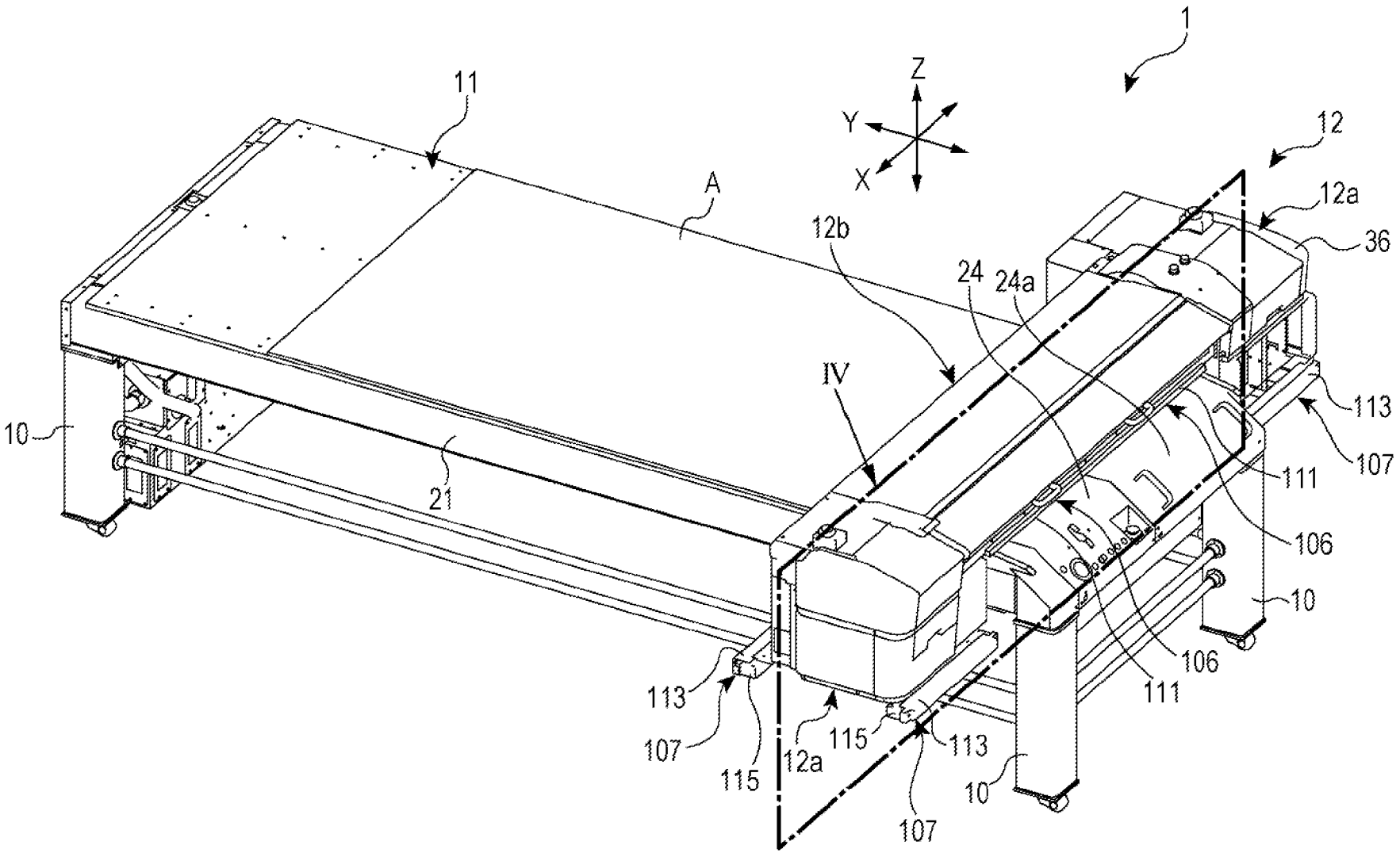
FIG. 1 is a perspective view showing an appearance of a recording apparatus according to an embodiment.
Figure 2:
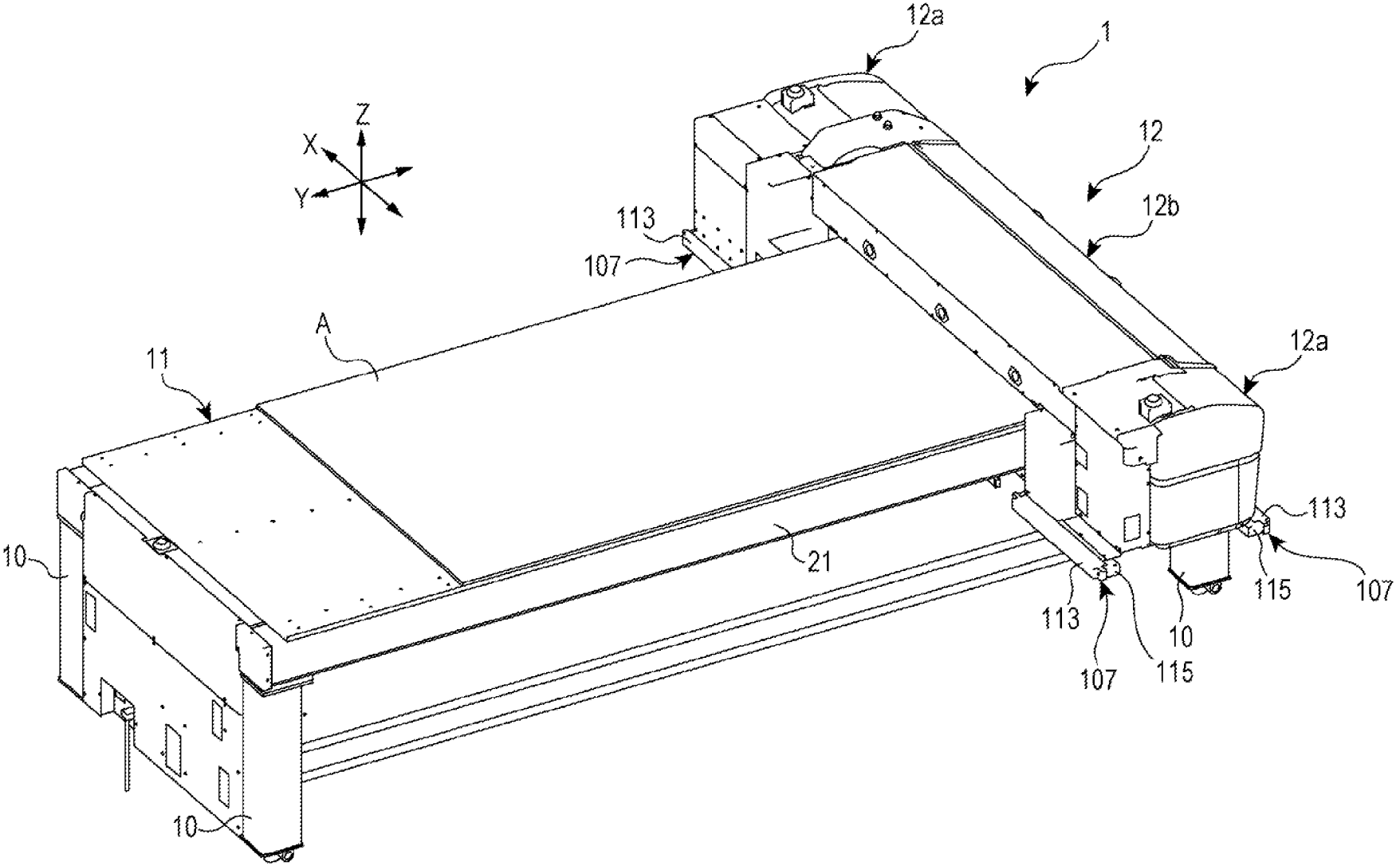
FIG. 2 is a perspective view of the appearance of the recording apparatus when viewed from a rear side.
Figure 3:
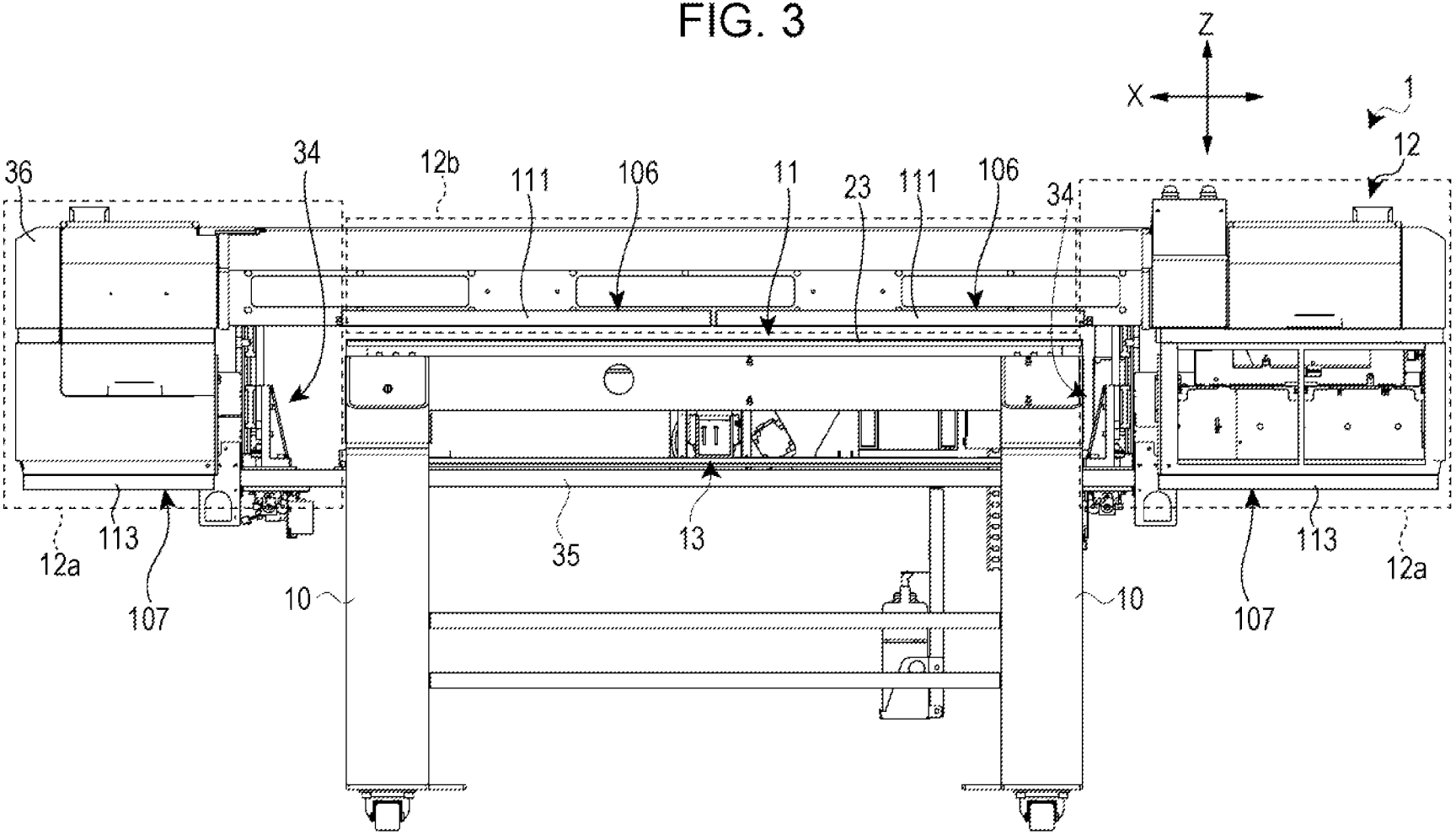
FIG. 3 is a front view showing the recording apparatus, in which a part of a support stage and a part of an apparatus cover are omitted.

As shown in FIGS. 1 to 3, a recording apparatus 1 is supported by four leg materials 10 with wheels and includes a support stage (stage) 11 for supporting a recording medium A, a gantry type recording processing section 12 with a recording unit 31 facing the supported recording medium A, and a Y-axis moving section (first moving section) 13 for supporting the recording processing section 12 and moving the recording processing section 12 in the Y-axis direction (second direction) with respect to the support stage 11. The recording processing section 12 is bridged so as to cross over the support stage 11 in an X-axis direction (first direction). In contrast, the Y-axis moving section 13 is arranged so as to be overlapped with the support stage 11 on the rear surface side of the support stage 11 and movably supports the recording processing section 12 on the rear surface side of the support stage 11.

Figure 8:
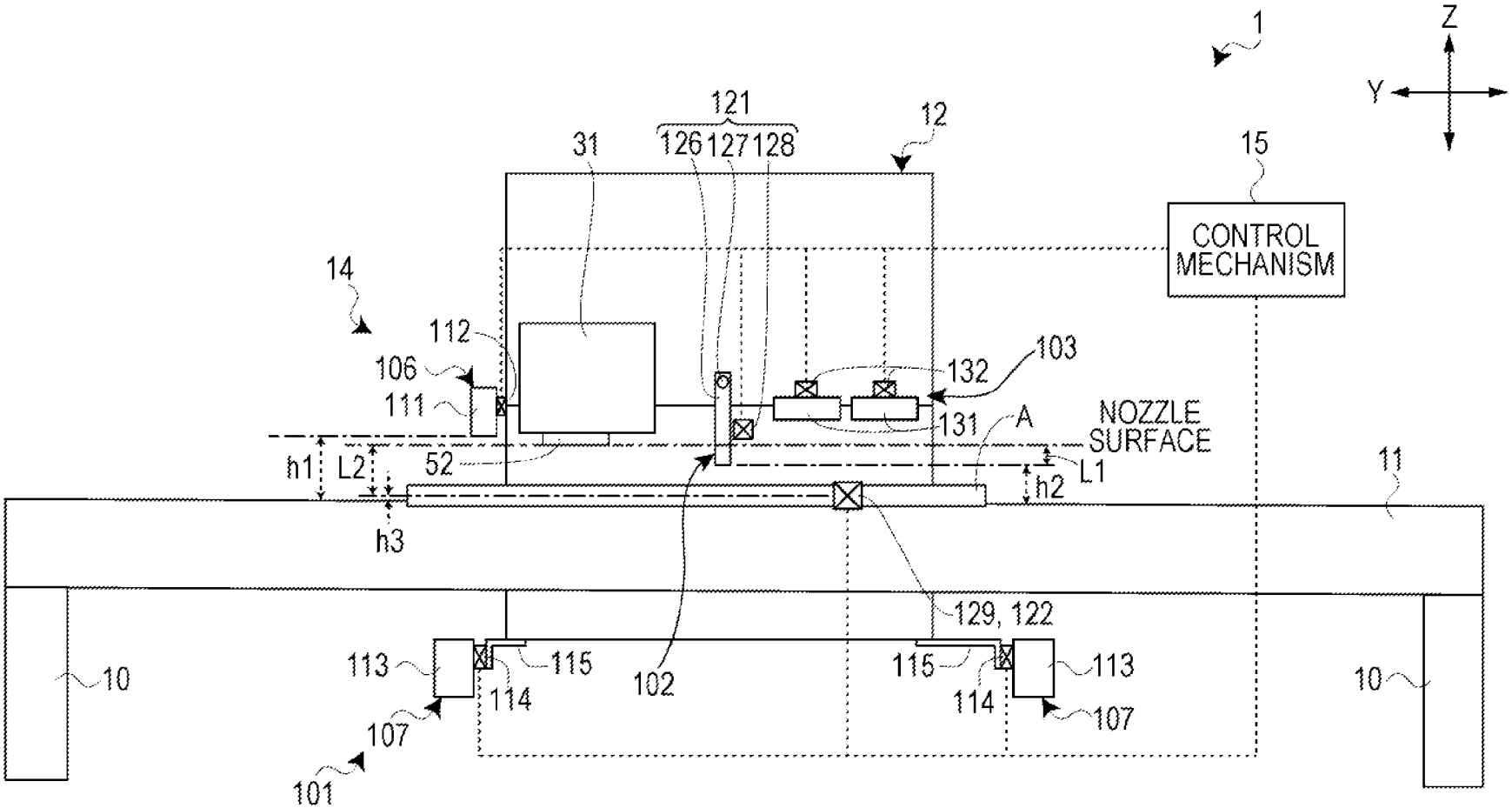
FIG. 8 is an outline of a side view showing a detection mechanism.

In addition, the recording apparatus 1 includes a detection mechanism 14 for detecting collision of a foreign matter and a height of the recording medium A, and a control mechanism 15 for controlling the aforementioned respective components (see FIG. 8 for both the detection mechanism 14 and the control mechanism 15). The control mechanism 15 stops driving the Y-axis moving section 13, for example, based on a detection result of the detection mechanism 14.

Figure 4:
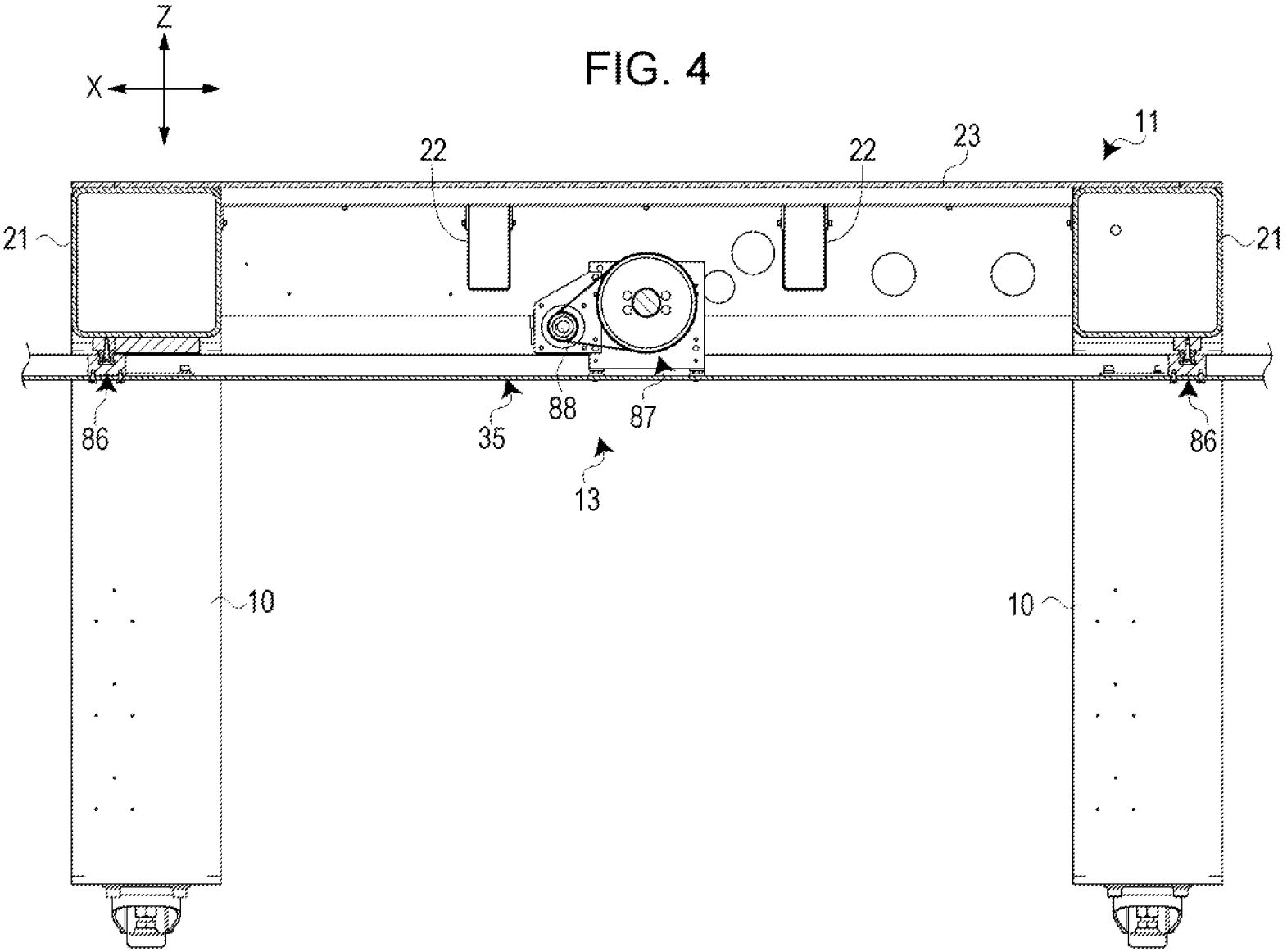
FIG. 4 is an IV-plane cross-sectional view showing a circumference of the support stage and a Y-axis moving section.

Next, a description will be given of the support stage 11 with reference to FIGS. 1, 3, and 4. FIG. 4 is an IV-plane cross-sectional view of a circumference of the support stage 11 and the Y-axis moving section 13 when viewed from the rear side. As shown in FIGS. 1, 3, and 4, the support stage 11 includes a pair of right and left beam-shaped structure materials 21 extending in the Y-axis direction, a plurality of support materials 22 arranged in longitudinal and latitude directions between the pair of structure materials 21, a suctioning table 23, which is supported by the pair of structure materials 21 and the plurality of support materials 22, and by and on which the recording medium A is suctioned and set, and an operation panel section 24 arranged in front of the suctioning table 23. The suctioning table 23 includes a support surface for supporting the recording medium A. In addition, the support stage 11 is supported by the respective leg materials 10 at the ends of the respective structure materials 21. A wide opening and closing door 24*a* is provided at the right half of the operation panel section 24. When the recording processing section 12 is manually maintained, the maintenance of the recording processing section 12 is performed from the opening and closing door 24*a* by moving the recording processing section 12 to the near side (the front side in the Y-axis direction) and opening the opening and closing door 24*a*.

Figure 5:
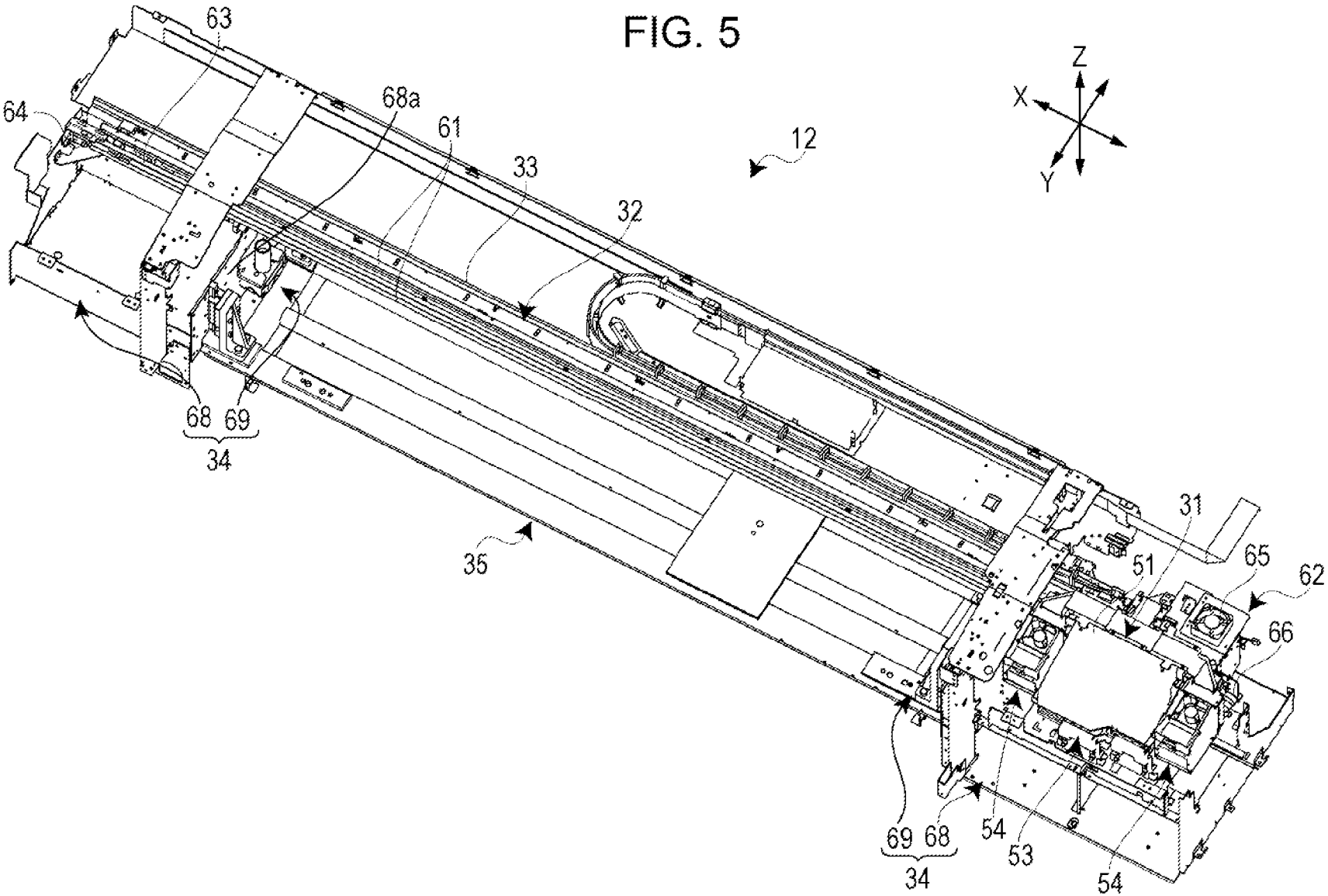
FIG. 5 is a perspective view showing a recording processing section, in which the apparatus cover is omitted.
Figure 6:
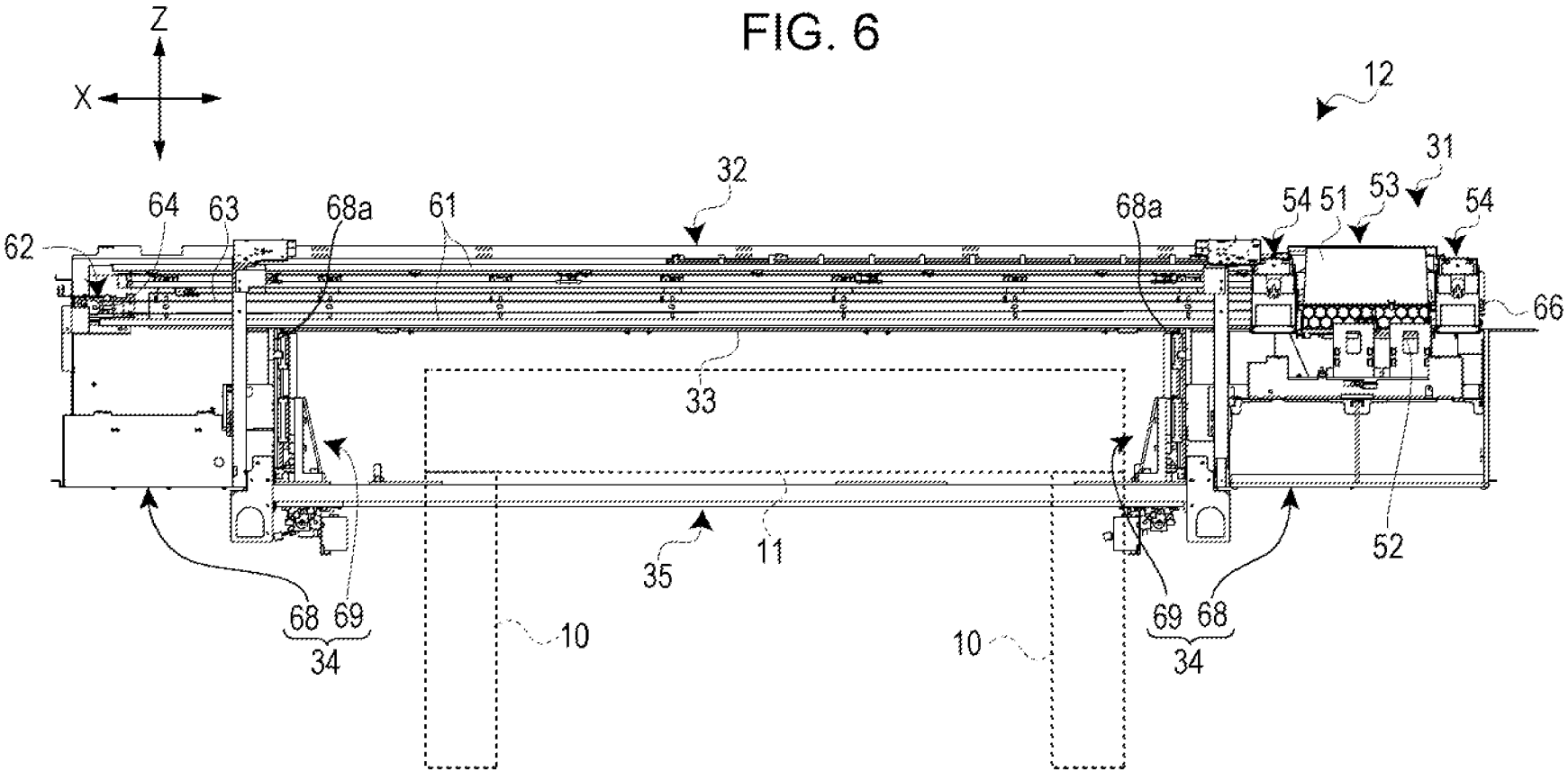
FIG. 6 is a front view showing the recording processing section, in which the apparatus cover is omitted.

As shown in FIGS. 5 and 6, the recording processing section 12 includes a recording unit 31 facing the supported recording medium A, an X-axis moving section 32 for supporting the recording unit 31 and moving the recording unit 31 in the X-axis direction, an erect laterally bridged frame 33 for supporting the X-axis moving section 32, a pair of right and left side frames 34 for supporting the laterally bridged frame 33 on both sides in the X-axis direction, a coupling frame 35 which couples base end sides of the pair of side frames 34, and an apparatus cover 36 (see FIG. 1) for covering these components. The laterally bridged frame 33 extends in the X-axis direction so as to cross over the support stage 11. In addition, the respective side frames 34 extend up to a lower part of the support stage 11, and the coupling frame 35 is coupled to lower ends of both of the side frames 34 below the support stage 11. Moreover, the Y-axis moving section 13 is arranged above the coupling frame 35 and couples the coupling frame 35 to the support stage 11.

As shown in FIGS. 1 to 3, the recording processing section 12 includes a pair of projecting portions (projecting sections) 12*a* horizontally projecting from the support stage 11. That is, the recording processing section 12 includes a pair of right and left projecting portions 12*a* projecting in the X-axis direction with respect to the support stage 11 and an overlapped portion (overlapped section) 12*b* overlapped with the support stage 11 in the X-axis direction on the surface side (upper side) of the support stage 11.

As shown in FIGS. 5 and 6, the recording unit 31 includes a carriage unit 53 in which two recording heads 52 is mounted on a box-shaped carriage 51 and a pair of ultraviolet irradiation units 54 arranged on the right and left sides of the carriage unit 53. The respective ultraviolet irradiation units 54 include ultraviolet irradiation LEDs for ultraviolet irradiation and irradiate ultraviolet curable ink ejected and landed by the recording head 52 with ultraviolet rays to cure (fix) the ultraviolet curable ink.

Each of the recording heads 52 is an ink jet head which is driven by a piezoelectric element (piezo element) to eject ink and includes a plurality of nozzle arrays (not shown) corresponding to colors which extend in the Y-axis direction. That is, the respective recording heads 52 are configured to be able to eject ultraviolet curable ink corresponding to a plurality of colors. In addition, nozzle surfaces of the recording heads 52 face the recording medium A. Moreover, the nozzle surfaces of the two recording heads 52 have the same heights. Although the ink jet heads based on a piezoelectric scheme is used in this embodiment, the invention is not limited thereto, and an ink jet head based on a thermal scheme, an electrostatic scheme, or the like may be used. In addition, the invention is not limited to such on-demand ink jet heads, and a continuous ink jet head may be used.

The X-axis moving section 32 includes a pair of upper and lower guide shafts 61 which are supported by the laterally bridged frame 33 and support the recording unit 31 such that the recording unit 31 can freely reciprocate in the X-axis direction and an X-axis drive mechanism 62 which directly drives the recording unit 31 along the pair of guide shafts 61.

The X-axis drive mechanism 62 includes a timing belt 63 extending in the X-axis direction along the pair of guide shafts 61, a main driving pulley 66 and a driven pulley 64 over which the timing belt 63 is stretched, a coupling and fixing section (not shown) which couples the timing belt 63 and the recording unit 31 (carriage 51), and a carriage motor 65 which drives the main driving pulley 66. The X-axis moving section 32 causes the recording unit 31 to reciprocate in the X-axis direction on the pair of guide shafts 61 via the timing belt 63 by rotating the carriage motor 65 in forward and reverse directions. The recording processing is performed by driving the respective recording heads 52 to eject ink along with the reciprocation.

Figure 7:
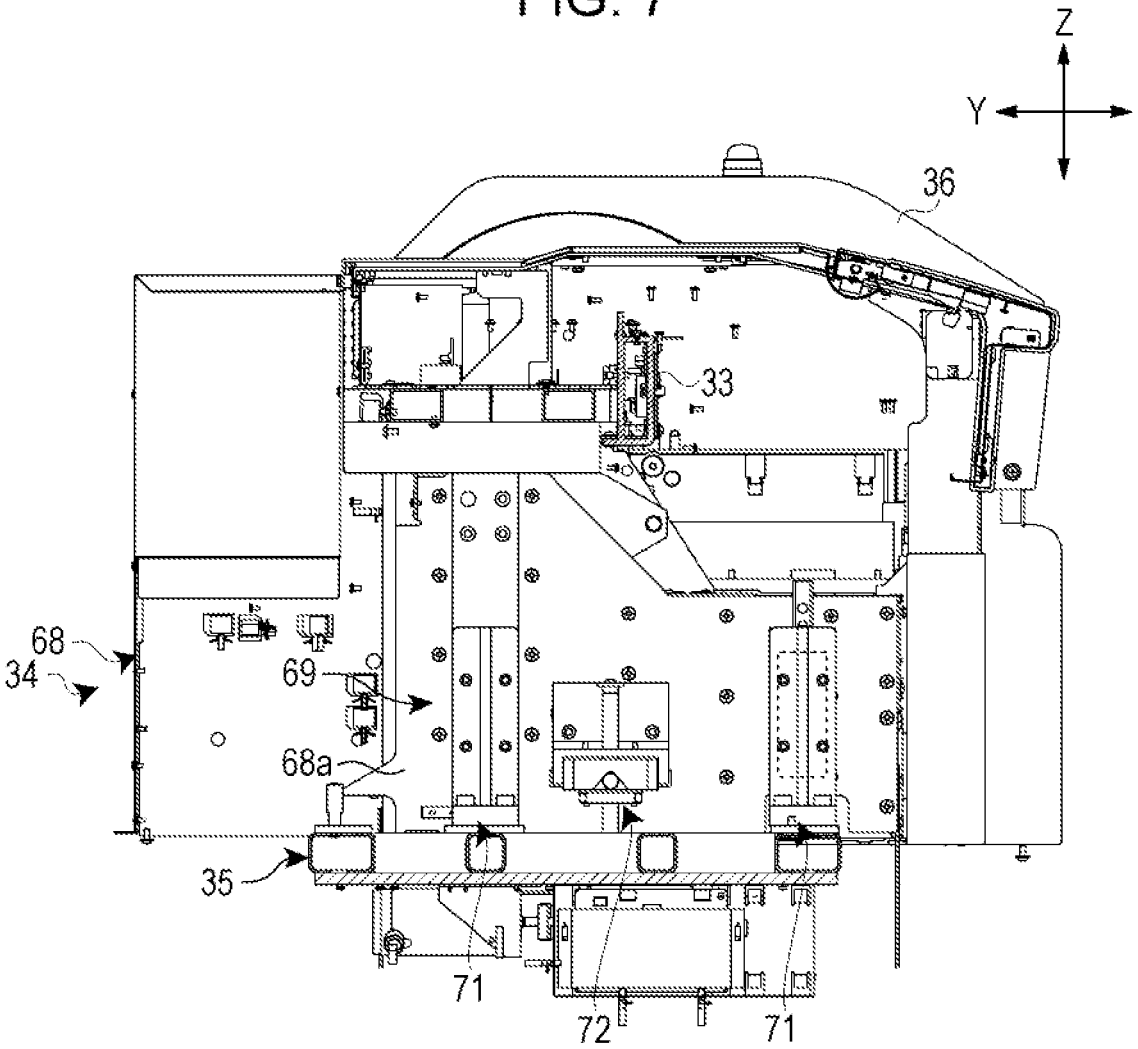
FIG. 7 is an inner side view showing a circumference of a side frame and an elevation section embedded therein.

Next, a description will be given of the side frames 34 with reference to FIGS. 5 to 7. As shown in FIGS. 5 to 7, an elevation section (second moving section) 69 for moving the recording unit 31 in the upper-lower direction and causing the recording unit 31 to approach and separate from the support stage 11 is embedded in each side frame 34. Specifically, each side frame 34 includes a box-shaped frame main body 68 for supporting the laterally bridged frame 33 and the elevation section 69 for coupling the frame main body 68 and the coupling frame 35 and moving the frame main body 68 up and down.

The pair of side frames 34 moves the recording unit 31 up and down via the respective frame main bodies 68, the laterally bridged frame 33, and the X-axis moving section 32 by causing the respective elevation sections 69 to move the frame main bodies 68 up and down. With such an operation, the recording unit 31 is made to approach and separate from the support stage 11 and the recording medium A supported by the support stage 11 (gap adjustment). That is, the respective frame main bodies 68, the laterally bridged frame 33, the X-axis moving section 32, the recording unit 31, and the apparatus cover 36 which covers these components are moved up and down by the respective elevation sections 69. Accordingly, movable bodies which are moved up and down by the elevation sections 69 are the respective frame main bodies 68, the laterally bridged frame 33, the X-axis moving section 32, the recording unit 31, and the apparatus cover 36.

The frame main bodies 68 support the laterally bridged frame 33 and include fixing plate sections 68*a* therein (on the side of the support stage 11) for fixing the movable sides of the respective elevation sections 69.

Each elevation section 69 includes a pair of front and back elevation guide mechanisms 71 which supports the frame main body 68 with respect to the coupling frame 35 such that the frame main body 68 can freely move up and down, an elevation drive mechanism 72 which is arranged between the pair of elevation guide mechanisms 71 and directly drives the frame main body 68 in the upper-lower direction, and an elevation drive motor (not shown) which drives the elevation drive mechanism 72. The respective elevation guide mechanisms 71 are configured of LM guide (registered trademark) mechanisms. In addition, the elevation drive mechanism 72 is configured of a ball screw mechanism.

As shown in FIG. 4, the Y-axis moving section 13 includes a pair of right and left linear guide mechanisms 86 which are positioned at both right and left ends of the support stage 11 on the rear side and support the recording processing section 12 with respect to the support stage 11 such that the recording processing section 12 can freely slide in the Y-axis direction, a Y-axis moving mechanism 87 which is positioned at the center of the support stage 11 on the rear side and moves the recording processing section 12 in the Y-axis direction with respect to the support stage 11, and a drive motor 88 which drives the Y-axis moving mechanism 87. The respective linear guide mechanisms 86 are configured of LM guide mechanisms. In addition, the Y-axis moving mechanism 87 is configured of a ball screw mechanism.

Figure 9:
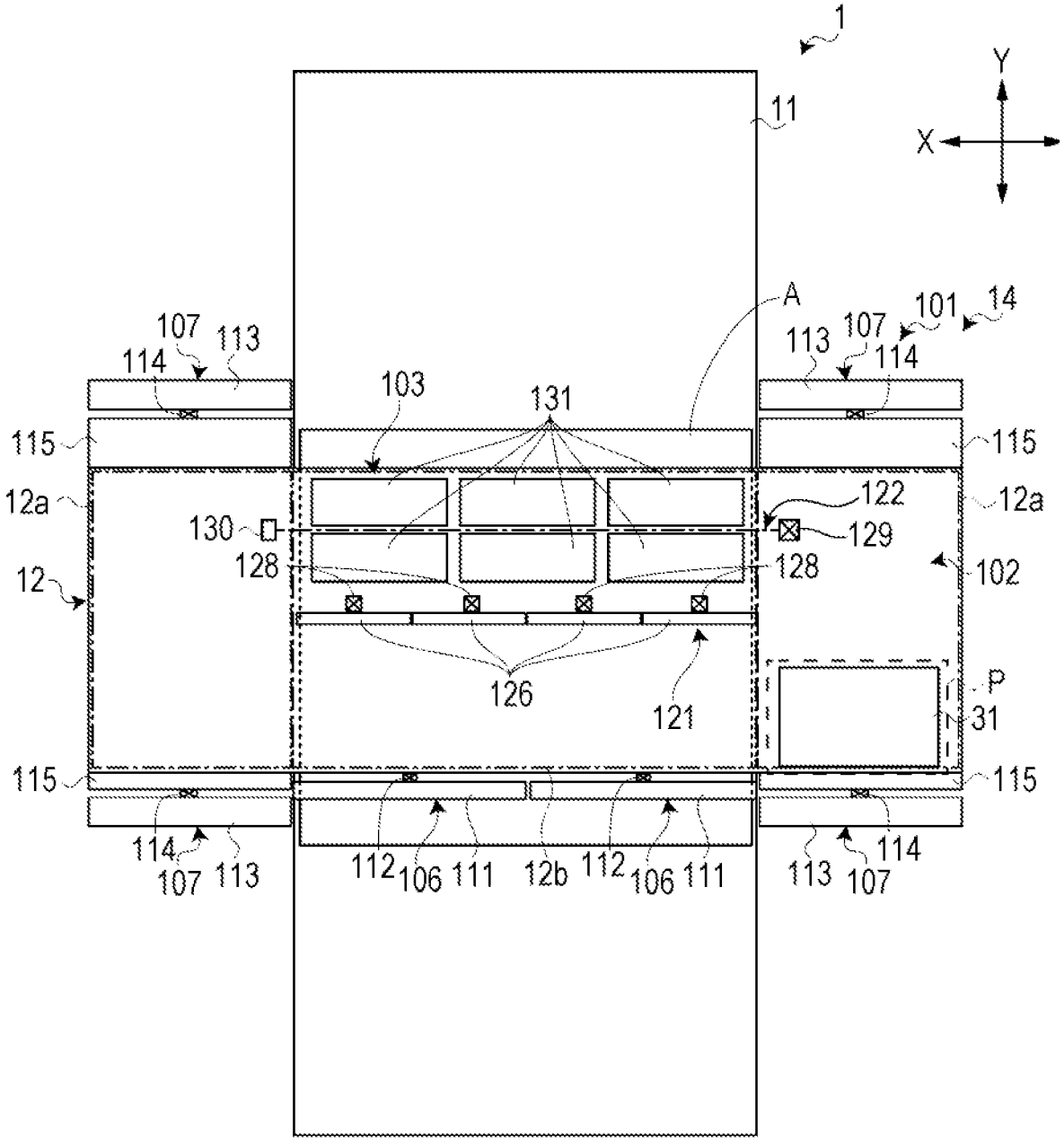
FIG. 9 is an outline of a front view showing the detection mechanism.

Here, a description will be given of the detection mechanism 14 with reference to FIGS. 1, 8, and 9. As shown in FIGS. 8 and 9, the detection mechanism 14 includes collision detection sections 101, a medium detection section 102, and an elevation collision detection section (third collision detection section) 103. The collision detection sections 101 are arranged on one side and the other side (front and rear sides) of the recording processing section 12 in the Y-axis direction and detects that a foreign matter has collided with the recording processing section 12 moved by the Y-axis moving section 13. The medium detection section 102 faces a front surface side and a side surface side of the recording medium A and detects a distance between the nozzle surface of the recording head 52 and the end of the recording medium A on the side of the recording head 52 in the Z-axis direction (a direction in which the recording unit 31 faces the support stage 11). In other words, the medium detection section 102 detects the height of the recording medium A (a distance from the support surface of the suctioning table 23 to the upper end of the recording medium A). The elevation collision detection section 103 is mounted on the recording processing section 12 at a position facing the support stage 11 (recording medium A) and detects that a foreign matter has collided with the movable bodies moved up and down by the elevation section 69.

As shown in FIGS. 1, 8, and 9, each collision detection section 101 includes two right and left front collision detection sections (second collision detection section) 106 arranged in front of (one side in the Y-axis direction) of the overlapped portion 12*b* of the recording processing section 12, and four side collision detection sections (first collision detection sections) 107 arranged on front and rear sides (the other side in the Y-axis direction) of each projecting portion 12*a* of the recording processing section 12.

Each front collision detection section 106 includes, in front of the overlapped portion 12*b*, a front bumper section 111 arranged at a lower end of the overlapped portion 12*b* and a front sensor section 112 arranged on the rear side of the front bumper section 111 to detect a behavior of the front bumper section 111.

The front bumper section 111 is supported with respect to the recording processing section 12 so as to freely advance and retreat in the front-back direction and is biased by a pressurizing spring, which is not shown in the drawing, in a direction away from the apparatus cover 36. The front bumper section 111 absorbs impact when a foreign matter collides by a hollow structure thereof and bias force of the pressurizing spring. The front bumper section 111 moves against the bias force of the pressurizing spring when brought into contact with the recording medium A. The front sensor section 112 detects the movement of the front bumper section 111 caused by the contact with the recording medium A and detects collision of the recording medium A. As shown in FIG. 9, the two front bumper sections 111 of the two front collision detection sections 106 are aligned and arranged in the X-axis direction. A total width of the two front bumper sections 111 in the X-axis direction is a width covering the entire width of the overlapped portion 12*b* (the length in the X-axis direction). When unevenness or bending (floating) occurs in the recording medium A in the X-axis direction, and the uneven or bent part partially exceeds a predetermined height, it is possible to precisely detect the unevenness or bending with the aforementioned configuration.

In addition, the respective front collision detection sections 106 are arranged such that the recording medium A is brought into contact with the front bumper sections 111 when the height of the recording medium A is equal to or greater than a first upper limit value h1. That is, the respective front collision detection sections 106 can detect whether or not the height of the recording medium A is equal to or greater than the first upper limit value h1. The height corresponding to the first upper limit value h1 is higher than the nozzle surface of the recording head 52.

Each side collision detection section 107 includes, on the front and rear sides of each projecting portion 12*a*, a side bumper section (first contact section) 113 arranged at a lower end of each projecting portion 12*a* via an arrangement member 115 and a side sensor section 114 arranged on the rear surface side of the side bumper section 113 to detect a behavior of the side bumper section 113. A configuration of the side bumper section 113 is the same as that of the aforementioned front bumper section 111, and thus detailed description will be omitted. The side sensor section 114 detects movement of the side bumper section 113 caused by contact with a foreign matter and detects collision of the foreign matter. In addition, each side bumper section 113 has a width (a length in the X-axis direction) covering the entire width of each projecting portion 12*a*.

As shown in FIG. 8, each side bumper section 113 is arranged by the arrangement member 115 at a lower position than the lower end of the projecting portion 12*a* in the vertical direction (Z-axis direction). In addition, each side bumper section 113 is arranged at a lower position than the support stage 11 in the vertical direction. Furthermore, the position of each side bumper section 113 in the vertical direction is set at a lower position than the lower surface of the support stage 11 by a length corresponding to a standard arm thickness in order to detect an arm of a user when the user curls their arm around the leg materials 10.

In addition, each side bumper section 113 of the side collision detection section 107 arranged in front of the projecting portion 12*a* is arranged by the arrangement member 115 at a position projecting further forward than the front bumper section 111 in the Y-axis direction.

As shown in FIGS. 7 and 8, the medium detection section 102 includes a first detection section 121 which faces the front surface side of the recording medium A and detects whether or not a distance between the nozzle surface of the recording head 52 and the recording medium A is less than a first predetermined value L1 and a second detection section 122 which faces the side surface side of the recording medium A and detects whether or not the distance between the nozzle surface of the recording head 52 and the recording medium A exceeds a second predetermined value L2 (L1<L2). The first predetermined value L1 is a lower limit value of the distance between the nozzle surface and the recording medium A, with which it is possible to normally perform recording on the recording medium A when the recording head 52 is arranged at a predetermined position in the Z-axis direction. The second predetermined value L2 is an upper limit value of the distance between the nozzle surface and the recording medium A, with which it is possible to normally perform recording on the recording medium A when the recording head 52 is arranged at a predetermined position in the Z-axis direction. In this embodiment, the first predetermined value L1 is 1.0 mm, and the second predetermined value L2 is 5.0 mm.

In other words, the first detection section 121 detects whether or not the height of the recording medium A exceeds a predetermined second upper limit value h2 (h2<h1), and the second detection section 122 detects whether or not the height of the recording medium A is less than a predetermined lower limit value h3 (h3<h2). The height corresponding to the second upper limit value h2 is lower than the recording head 52. The second upper limit value h2 corresponds to the aforementioned first predetermined value L1, and the lower limit value h3 corresponds to the aforementioned second predetermined value L2.

Both the first detection section 121 and the second detection section 122 are mounted on the recording processing section 12. Furthermore, the first detection section 121 and the second detection section 122 are mounted on the movable bodies which are moved up and down by the elevation sections 69, and the medium detection section 102 detects a relative height of (the surface of) the recording medium A with respect to the movable bodies. With such a configuration, the medium detection section 102 detects a relative position (height) of the surface of the recording medium A with respect to the recording head 52 and detects the distance between the nozzle surface of the recording head 52 and the recording medium A.

The first detection section 121 includes a plurality of contact pieces (second contact section) 126 which are aligned and arranged in the X-axis direction and can be brought into contact with the surface of the recording medium A when the recording processing section 12 moves, a rotation shaft 127 which rotatably supports bases of the plurality of contact pieces 126, and a plurality of contact-type sensor sections 128 which respectively detect rotation of the respective contact pieces 126 in contact with the recording medium A. If the recording medium A is brought into contact with the tip end of the respective contact pieces 126 in an erecting posture when the recording processing section 12 moves, the respective contact pieces 126 are rotated backward, and the respective contact-type sensor sections 128 detect the rotation. With such an operation, it is determined whether or not the distance between the nozzle surface of the recording head 52 and the recording medium A is less than the first predetermined value L1 (whether or not the surface of the recording medium A corresponds to a height exceeding the second upper limit value h2).

In addition, the plurality of contact pieces 126 are aligned and arranged in the X-axis direction. A total width of the plurality of contact pieces 126 in the X-axis direction is a width covering the entire width of the recording medium A (the length in the X-axis direction). It is possible to perform the detection at respective positions in the X-axis direction and the Y-axis direction by moving the plurality of contact pieces in the Y-axis direction along with the recording processing section 12. That is, when unevenness or bending (floating) occurs in the recording medium A, and the height of the uneven or bent part is partially less than the first predetermined value L1, it is possible to detect the unevenness or the bending.

In addition, the contact pieces 126 are configured such that the heights thereof can be adjusted. By the height adjustment, the contact pieces 126 are rotated by the contact with the recording medium A when the distance between the nozzle surface of the recording head 52 and the recording medium A is less than the first predetermined value L1, and the contact pieces 126 are adjusted so as not to be in contact with the recording medium A when the distance between the nozzle surface and the recording medium A is equal to or greater than the first predetermined value L1. The expression "not to be in contact" herein includes not only a case where the recording medium A and the contact pieces 126 are completely not in contact with each other but also a case where the contact-type sensor sections 128 do not detect rotation of the contact pieces 126 even when the recording medium A and the contact pieces 126 are in contact with each other and a case where a detected rotation angle of the contact pieces 126 is equal to or less than a predetermined rotation angle set in consideration of a detection error and the like even when the recording medium A and the contact pieces 126 are in contact with each other and the contact-type sensor sections 128 detect rotation of the contact pieces 126. In addition, a detection available range in which the first detection section 121 can normally perform detection is greater than the second upper limit value h2 and equal to or less than the first upper limit value h1. That is, the detection available range by the first detection section 121 and the detection available range by the front collision detection section 106 are configured to be partially overlapped.

The second detection section 122 includes a light emitting and receiving section 129 and a reflection section 130 which are arranged so as to face each other with the support stage 11 interposed therebetween. The light emitting and receiving section 129 irradiates the reflection section 130 with detection light and receives the detection light reflected by the reflection section 130. That is, since the recording medium A interrupts the detection light if the distance between the nozzle surface of the recording head 52 and the recording medium A is equal to or less than the second predetermined value L2, the light emitting and receiving section 129 does not receive the detection light. In contrast, since the recording medium A does not interrupt the detection light when the distance between the nozzle surface and the recording medium A exceeds the second predetermined value L2, the light emitting and receiving section 129 receives the detection light. As described above, the second detection section 122 detects whether or not the distance between the nozzle surface and the recording medium A exceeds the second predetermined value L2 based on whether or not the detection light has been received.

The elevation collision detection section 103 includes a plurality of contact members (fourth contact sections) 131 arranged on the lower surface side of the overlapped portion 12*b* so as to face the support stage 11 and be longitudinally and laterally aligned and a plurality of elevation sensor sections 132 which are respectively arranged on the rear surfaces (upper sides) of the respective contact members 131 and detects behaviors of the respective contact members 131. The respective contact members 131 are contacts which are brought into contact with a foreign matter and detect collision. In contrast, the respective elevation sensor sections 132 are detectors which detect movement of the contacts caused by the contact with the foreign matter and detect collision.

Here, a description will be given of a recording operation by the recording apparatus 1 with reference to FIG. 10. The recording operation is configured of a preliminary operation of moving the recording unit 31 from the rear side (far side) to the front side (near side) in the Y-axis direction to perform abnormality detection and a main operation of moving the recording unit 31 from the front side (near side) to the rear side (far side) in the Y-axis direction after the preliminary operation to perform recording processing.

Figure 10:
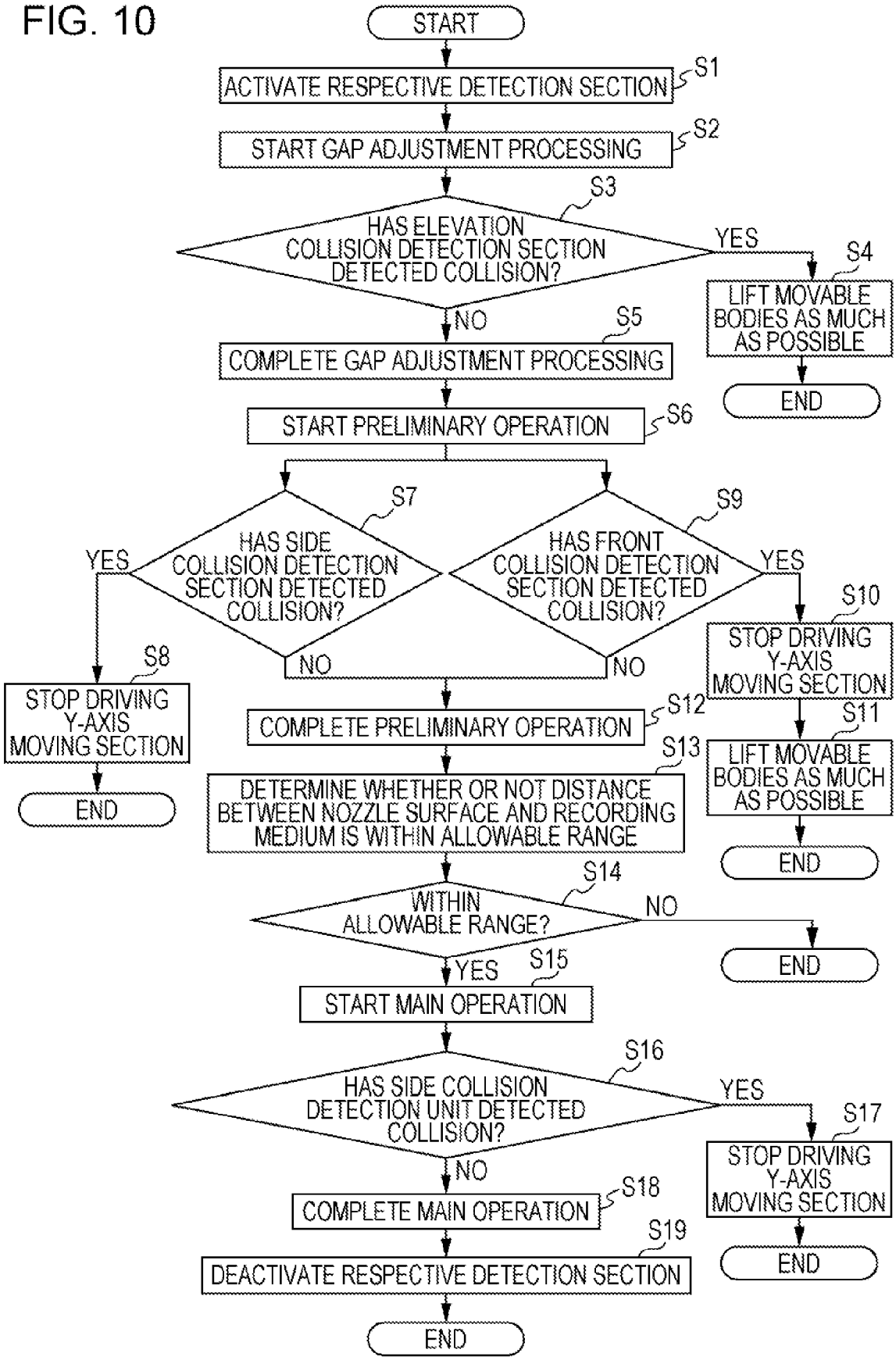
FIG. 10 is a flowchart showing a recording operation by the recording apparatus.

As shown in FIG. 10, the recording apparatus 1 first causes the control mechanism 15 to activate (ON) the collision detection sections 101, the medium detection section 102, and the elevation collision detection section 103 (S1) and then starts gap adjustment processing (S2). In the gap adjustment processing, the recording apparatus 1 drives the elevation sections 69 based on the thickness (height) of the recording medium A or a gap value input by the user and moves the recording unit 31 up and down such that the interval between the surface of the recording medium A and the nozzle surface of the recording head 52 becomes a predetermined gap. If the elevation collision detection section 103 detects collision (pinching) of a foreign matter at this timing (S3: Yes), the control mechanism 15 controls the elevation section 69 in response to the detection, lifts the movable bodies as much as possible (S4), causes the operation panel 24 to provide information about the error, and completes the recording operation.

In contrast, if the gap adjustment processing is completed (S5) without detecting collision of a foreign matter (S3: No), the preliminary operation is started (S6). In the preliminary operation, the Y-axis moving section 13 is driven, and the recording processing section 12 is moved from the rear side to the front side in the Y-axis direction in a state where the respective detection sections are activated and the recording unit 31 is moved to a home position P (see FIG. 9) at a right end in the X-axis direction. If the side collision detection section 107 detects collision of a foreign matter at this timing (S7: Yes), the control mechanism 15 stops driving the Y-axis moving section 13 in response to the detection (S8), causes the operation panel 24 to provide information about the error, and then completes the recording operation. In contrast, if the front collision detection sections 106 detect collision of the recording medium A (S9: Yes), the control mechanism 15 stops driving the Y-axis moving section 13 in response to the detection (S10), controls the elevation sections 69 to lift the movable bodies as much as possible (S11), causes the operation panel 24 to provide information about the error, and then completes the recording operation.

In contrast, if the preliminary operation is completed (S12) without detecting collision of a foreign matter and the recording medium A (S7: No, S8: No), the control mechanism 15 determines whether or not the distance (the height of the recording medium A) between the nozzle surface of the recording head 52 and the recording medium A is within an allowable range (equal to or greater than the lower limit value L1 and equal to or less than the upper limit value L2) based on the detection result by the medium detection section 102 which is currently performing the preliminary operation (S13). That is, if the contact-type sensor sections 128 of the first detection section 121 do not detect rotation of the contact pieces 126 even once during the preliminary operation, and the light emitting and receiving section 129 of the second detection section 122 does not detect reception of the detection light even once during the preliminary operation, it is determined that the distance (the height of the recording medium A) between the nozzle surface and the recording medium A is within the allowable range. In contrast, if the contact-type sensor sections 128 detect rotation of the contact pieces 126 or the light emitting and receiving section 129 detects reception of the detection light during the preliminary operation, it is determined that the distance (the height of the recording medium A) between the nozzle surface and the recording medium A is outside the allowable range. If it is determined that the distance (the height of the recording medium A) between the nozzle surface and the recording medium A is without the allowable range (S14: No), the recording operation is completed without performing the main operation.

In contrast, if it is determined that the distance (the height of the recording medium A) between the nozzle surface and the recording medium A is within the allowable range (S14: Yes), the main operation is started (S15). In the main operation, the recording head 52 is made to eject ink while the recording processing section 12 is intermittently moved from the front side to the rear side in the Y-axis direction and the recording unit 31 is moved in the X-axis direction by the X-axis moving section 32. If the side collision detection section 107 detects collision of a foreign matter at this timing (S16: Yes), the control mechanism 15 stops driving the Y-axis moving section 13 in response to the detection (S17), causes the operation panel 24 to provide information about the error, and then completes the recording operation.

In contrast, if the main operation is completed (S18) without detecting collision of a foreign matter or the recording medium A (S16: No), the respective detection sections are deactivated (OFF) (S19), and the recording operation is completed.

According to the aforementioned configuration, it is possible to detect that a foreign matter has collided with the projecting portions 12*a* by arranging the contact sections (side bumper sections 113), which are brought into contact with the foreign matter and detect collision, before and after the pair of right and left projecting portions 12*a*. For this reason, it is possible to quickly stop driving the Y-axis moving section 13 when the foreign matter collides with the projecting portions 12*a* and to thereby prevent the foreign matter and the recording apparatus 1 itself from being damaged.

In addition, since impact when a foreign matter collides is absorbed by mounting the impact absorbing mechanism on the side bumper sections 113, it is possible to effectively prevent the foreign matter or the recording apparatus 1 itself from being damaged.

Furthermore, it is possible to detect collision between a foreign matter, which is located at a lower position than the support stage 11, and the projecting portions 12*a* by arranging the side bumper sections 113 at lower positions than the support stage 11.

Furthermore, it is possible to detect that the recording medium A supported by the support stage 11 has collided with the overlapped portion 12*b* by arranging the contact sections (front bumper sections 111) which are brought into contact with the recording medium A and detects collision of the recording medium A on the front side of the overlapped portion 12*b*. Therefore, it is possible to quickly stop driving the Y-axis moving section 13, for example, and to thereby effectively prevent the recording medium A or the recording processing section 12 itself from being damaged when the height of the recording medium A is high and the recording medium A collides with the overlapped portion 12*b*. In particular, there is a case where the user erroneously inputs the thickness of the recording medium A and the height of the recording medium A is high relative to the overlapped portion 12*b*. It is possible to handle such a case with the aforementioned configuration.

When a foreign matter is present over the inside and the outside of the support stage 11 in the X-axis direction, the foreign matter is brought into contact with the side bumper sections 113 first, and the collision is detected since the side bumper sections 113 arranged on the front side of the projecting portions 12*a* of the recording processing section 12 are arranged further on a front side than the front bumper sections 111 arranged at the overlapped portion 12*b* of the recording processing section 12. For this reason, collision itself of the foreign matter does not occur in the overlapped portion 12*b*, and it is possible to effectively prevent the recording processing section 12 from being damaged.

Furthermore, it is possible to prevent the recording medium A from being brought into contact with the recording head 52 by completing the recording operation without performing the main operation when the distance between the nozzle surface and the recording medium A is less than the first predetermined value L1, based on the detection result of the first detection section 121. With such a configuration, it is possible to prevent the recording head 52 from being damaged. In contrast, it is possible to prevent the irradiation light (ultraviolet ray) of the ultraviolet irradiation unit 54 from being reflected by the recording medium A or the like and reaching the recording head 52 by completing the recording operation without performing the main operation when the distance between the nozzle surface and the recording medium A exceeds the second predetermined value L2, based on the detection result of the second detection section 122. With such a configuration, it is possible to prevent clogging of the recording head 52 without causing ink in the circumference of the ejection nozzle to cure due to the irradiation light.

Furthermore, it is possible to suppress the possibility that the recording medium A is damaged and to easily perform adjustment after the attachment by providing the contact-type first detection section 121 and the optical-type second detection section 122.

Furthermore, it is possible to perform detection at the respective positions on the recording medium A in the X-axis direction by aligning and arranging a plurality of contact pieces 126 in the X-axis direction. Accordingly, even if unevenness or bending (floating) occurs in the X-axis direction, and the distance is partially less than the first predetermined value L1, it is possible to detect the unevenness or the bending. In addition, it is possible to move the contact pieces 126 along with the recording processing section 12 due to the arrangement of the contact pieces 126 on the recording processing section 12 and to thereby perform detection at the respective positions on the recording medium A in the Y-axis direction. Accordingly, even if unevenness or bending (floating) occurs in the Y-axis direction, and the distance is partially less than the first predetermined value L1, it is possible to detect the unevenness or the bending.

In addition, it is possible to detect that a foreign matter has been pinched between the movable bodies and the support stage 11 (or the recording medium A) when the elevation sections 69 move up or down, by providing the elevation collision detection section 103. For this reason, it is possible to quickly stop driving the elevation sections 69 and move the movable bodies to separate therefrom when the foreign matter is pinched and to thereby effectively prevent the foreign matter and the recording apparatus 1 itself from being damaged.

Although this embodiment is configured such that the side collision detection sections 107 and the side bumper sections 113 are respectively arranged before and after the respective projecting portions 12*a*, a configuration in which the side collision detection sections 107 and the side bumper sections 113 are arranged only on one side of the front and rear sides of the respective projecting portions 12*a* is also applicable. That is, a configuration in which the side collision detection sections 107 and the side bumper sections 113 are arranged only on the front side in the moving direction in the preliminary operation or a configuration in which the side collision detection sections 107 and the side bumper sections 113 are arranged only on the front side in the moving direction in the main direction is also applicable. In addition, a configuration in which the side collision detection section 107 and the side bumper section 113 are arranged only one side of the pair of right and left projecting portions 12*a* is also applicable.

Furthermore, although this embodiment is configured such that the front collision detection sections 106 and the front bumper sections 111 are arranged only on the front side of the overlapped portion 12*b*, a configuration in which the front collision detection sections 106 and the front bumper sections 111 are respectively arranged before and after the overlapped portion 12*b* or a configuration in which the front collision detection sections 106 and the front bumper sections 111 are arranged only on the rear side of the overlapped portion 12*b* is also applicable.

Furthermore, this embodiment may be configured such that a mechanism for causing the first detection sections 121 to retreat upward when the respective contact pieces 126 of the first detection sections 121 collide with a foreign matter during the up and down movement by the elevation section 69 is mounted. For example, this embodiment may be configured to include a bias spring (bias section) which supports the first detection sections 121 between a detection position for performing lower limit detection and a retreat position retreating upward from the detection position such that the first detection section 121 can freely move up and down and biases the first detection sections 121 to the side of the detection position. With such a configuration, the foreign matter and the first detection section 121 itself are not damaged by the contact pieces 126 even if the tip ends of the contact pieces 126 are located at lower positions than the contact members 131 of the elevation collision detection section 103.

Although the present invention is applied to the recording apparatus 1 which performs recording by moving the recording unit 31 in the X and Y directions in this embodiment, a configuration in which the present invention is applied to a recording apparatus 1 (a so-called line printer) which performs recording by moving the recording unit 31 with a line head only in the Y-axis direction is also applicable.

Furthermore, although the second detection section 122 of this embodiment is configured such that the light emitted from the light emitting and receiving section 129 is blocked by the side surface of the recording medium A, a configuration in which the light emitted from the light emitting and receiving section 129 is blocked by the side surface of the support stage 11 is also applicable. That is, any configuration is applicable as long as the detection light is interrupted when the distance between the nozzle surface of the recording head 52 and the recording medium A is equal to or less than the second predetermined value L2. In addition, although a contact-type detection mechanism and an optical-type detection mechanism are employed as the first detection section 121 and the second detection section 122, respectively, the configurations of the detection mechanisms for the first detection section 121 and the second detection section 122 are not limited to the aforementioned configurations.

Furthermore, although this embodiment is configured such that collision with a foreign matter or a recording medium A is detected by the front collision detection sections 106 and the side collision detection sections 107 after the foreign matter or the recording medium A collides (contacts), a configuration in which the collision with the foreign matter or the recording medium A is detected before the foreign matter or the recording medium A collides is also applicable. In such a case, the front collision detection sections 106 and the side collision detection sections 107 are preferably configured of optical-type detection mechanisms.

The entire disclosure of Japanese Patent Application No. 2013-065986, filed Mar. 27, 2013 is expressly incorporated by reference herein

What is claimed is:

1. A recording apparatus comprising:

a stage which includes a support surface for supporting a recording medium;

a recording processing section which includes a recording unit for performing recording on the recording medium supported by the stage and is bridged so as to cross over the stage in a first direction;

a first moving section which moves the recording processing section in a second direction perpendicular to the first direction and along the support surface, with respect to the stage; and a first collision detection section which detects collision between a foreign matter and the recording processing section, wherein the recording processing section includes projecting sections which project in the first direction with respect to the stage, and wherein the first collision detection section is arranged on at least one of one side and the other side of the projecting sections in the second direction.

2. The recording apparatus according to claim 1, wherein the recording processing section includes an overlapped section which is overlapped with the stage in the first direction, and wherein the recording apparatus further includes a second collision detection section which is arranged on at least one of one side and the other side of the overlapped section in the second direction and detects collision between the recording medium or the foreign matter and the recording processing section.

3. The recording apparatus according to claim 2, wherein the first collision detection section is arranged at a position projecting further than the second collision detection section in the second direction.

4. The recording apparatus according to claim 1, wherein the first collision detection section is arranged at a lower position than the stage.

5. The recording apparatus according to claim 1, wherein the first collision detection section includes a first contact section which is able to be brought into contact with the foreign matter.

6. The recording apparatus according to claim 1, further comprising:

a medium detection section which detects a distance between the recording unit and the recording medium in a direction in which the recording unit faces the stage, wherein the medium detection section includes a contact-type first detection section which performs lower limit detection of the distance between the recording unit and the recording medium, and an optical-type second detection section which performs upper limit detection of the distance between the recording unit and the recording medium.

7. The recording apparatus according to claim 6, wherein the first detection section includes a plurality of second contact sections which are aligned and arranged in the first direction and are able to be brought into contact with the recording medium, and wherein the plurality of second contact sections are supported by the recording processing section.

8. The recording apparatus according to claim 1, wherein the recording processing section further includes a second moving section for moving movable bodies including the recording unit in the direction in which the recording unit faces the stage, and a third collision detection section which detects collision between the foreign matter and the recording unit when the movable bodies are moved in the facing direction by the second moving section.

* * * * *